US008336612B2

(12) United States Patent
Robertson et al.

(10) Patent No.: US 8,336,612 B2
(45) **Date of Patent: *Dec. 25, 2012**

(54) SEVERING OF DOWNHOLE TUBING WITH ASSOCIATED CABLE

(75) Inventors: Michael C. Robertson, Arlington, TX (US); William Boelte, New Iberia, LA (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/200,064

(22) Filed: Sep. 16, 2011

(65) Prior Publication Data

US 2012/0006547 A1 Jan. 12, 2012

Related U.S. Application Data

(63) Continuation of application No. 12/055,434, filed on Mar. 26, 2008, now Pat. No. 8,020,619.

(51) Int. Cl.
*E21B 29/04* (2006.01)
*E21B 29/00* (2006.01)

(52) U.S. Cl. ..... 166/54.5; 166/55; 166/55.6; 166/55.7; 166/297

(58) Field of Classification Search ..... 166/297, 166/298, 54.5, 55, 55.6, 55.7
See application file for complete search history.

(56) References Cited

U.S. PATENT DOCUMENTS

| | | | | |
|---|---|---|---|---|
| 4,306,622 | A * | 12/1981 | Armstrong | 166/297 |
| 6,925,937 | B2 * | 8/2005 | Robertson | 102/202 |
| 8,020,619 | B1 * | 9/2011 | Robertson et al. | 166/297 |

* cited by examiner

*Primary Examiner* — Brad Harcourt
(74) *Attorney, Agent, or Firm* — The Matthews Firm

(57) ABSTRACT

Methods for severing a tubular string having a cable in association therewith can include lowering a cutting apparatus into the tubular string and actuating the cutting apparatus to form a cut in the tubular string and sever the cable. Severing the cable in this manner can be performed through a single actuation of a single cutting apparatus, enabling at least a portion of the tubular string to be subsequently severed and retrieved, unimpeded by the cable.

19 Claims, 6 Drawing Sheets

SEVERING OF DOWNHOLE TUBING WITH ASSOCIATED CABLE

CROSS REFERENCE TO RELATED APPLICATIONS

The present application is a continuation application, which claims priority to the U.S. patent application having the Ser. No. 12/055,434, filed Mar. 26, 2008, now U.S. Pat. No. 8,020,619 the entirety of which is incorporated herein by reference.

FIELD

The present disclosure relates, generally, to methods for severing tubing in downhole wells.

BACKGROUND

In oil and gas wells fluids are typically produced to the surface by way of production pipe or tubing. The production tubing extends downward from the well head at the surface into the production zone.

At certain times, such as when the well ceases to produce economically, it is desirable to remove and salvage the production tubing from the well for use in another well.

If the production tubing cannot be successfully pulled from the well, it is frequently possible to cut or sever the tubing and salvage at least a portion thereof. Typically, to cut the tubing, a torch is lowered therein and actuated for this purpose. For example, an effective cutting tool for cutting production tubing, a radial cutting torch, is described in U.S. Pat. No. 6,598,679, the entirety of which is incorporated herein by reference. The torch projects cutting fluids in a radial direction about its circumference to sever the tubing with a circumferential cut. The portion of the tubing located above the cut can then be readily pulled from the well.

Some wells include cables or control lines that extend downhole, e.g., for controlling equipment within the well. For example, a well may be provided with an electric submersible pump, which utilizes a power cable, and/or a safety valve that utilizes a hydraulic control line that extends on the outside of the production tubing, attached thereto using clamps.

Cutting production tubing having an exterior cable or line can present difficulty due to the fact that simply cutting the tubing using conventional means normally leaves the cable intact, such that the upper and lower portions of the tubing remain connected by the cable. Cutting the cable can be a difficult undertaking due to the fact that the tubing effectively shields the cable from the cutting torch.

Conventional methods include a two-step process to cut such a cable. First, a first torch is lowered into the production tubing to make a first cut through the tubing. This creates an opening in the tubing that exposes the cable to the inside thereof. Then, the first torch is removed and a second torch is lowered into the production tubing. The second torch is then used to cut the cable through the opening in the tubing. Aligning the second torch with the opening in the tubing is often difficult, and a misalignment of the second torch results in the cable remaining uncut, requiring another torch to be lowered into the tubing for another attempt, increasing the cost of salvaging the tubing.

Therefore, a need exists for methods of cutting a cable that do not require alignment of a torch with an opening in a tubular member.

Embodiments within the present disclosure meet these needs.

SUMMARY

Embodiments of the present invention can include a method of severing a tubular string, the tubular string having a cable extending along a length thereof. A cutting apparatus (e.g., a cutting torch) is lowered into the tubing to a desired location, then is actuated (e.g., ignited to produce cutting fluids) to cut through the tubing and sever the cable. For example, in a specific embodiment, a cutting torch having apertures for directing cutting fluids therethrough can be used to direct the cutting fluids to cut the tubing along a partial circumference thereof, e.g., by directing the cutting fluids in a circumferential arc of 180 degrees or less, to enable the cutting fluids to be directed with sufficient force to cut both the tubing and the cable. Thus, the first cut made by the cutting apparatus can both cut through the tubing and sever the cable simultaneously.

After severing the cable, a second cutting apparatus (e.g., a radial cutting torch) can be lowered and actuated to form a second cut (e.g., a circumferential cut) in the production tubing to enable an upper portion of tubing to be retrieved, unhindered by the cable, due to the fact that the cable was severed using the first cutting apparatus.

BRIEF DESCRIPTION OF THE DRAWINGS

In the detailed description of various embodiments of the present invention presented below, reference is made to the accompanying drawings, in which.

Embodiments of the present disclosure are described below with reference to the listed Figures.

DETAILED DESCRIPTION OF THE EMBODIMENTS

Before describing selected embodiments of the present invention in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired to facilitate understanding or explanation. As well, the relative size and arrangement of the components may differ from that shown and still operate within the spirit of the invention as described throughout the present application.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the inventive concept(s) herein taught, and because many modifications may be made in the embodiments described herein, it is to be understood that the details herein are to be interpreted as illustrative and non-limiting.

Figure 1:
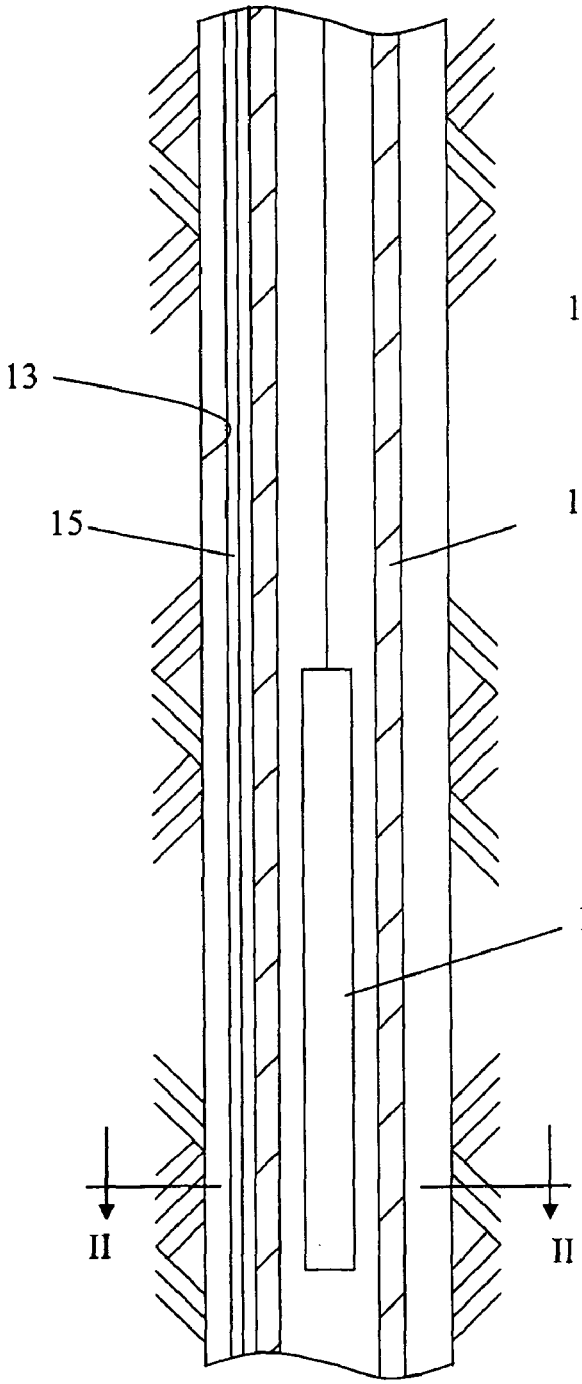
FIG. 1 depicts a cross-sectional view of an embodiment of production tubing having a cable extending along a length thereof, and a cutting device positioned within the tubing.

Referring to FIG. 1, the depicted embodiment is usable to cut a tubular member (11) (e.g., production tubing) within a well (13), the tubular member (11) having a cable (15) associated therewith. The cable (15) is shown extending along an exterior length of the tubular member (11) in such a manner that use of conventional methods to sever the tubular member (11) and retrieve an upper portion thereof would be impeded by the cable (15). Embodiments of the present invention described herein can cut the cable (15) and the tubular member (11) without requiring precise alignment of cutting devices (e.g., torches).

Figure 3:
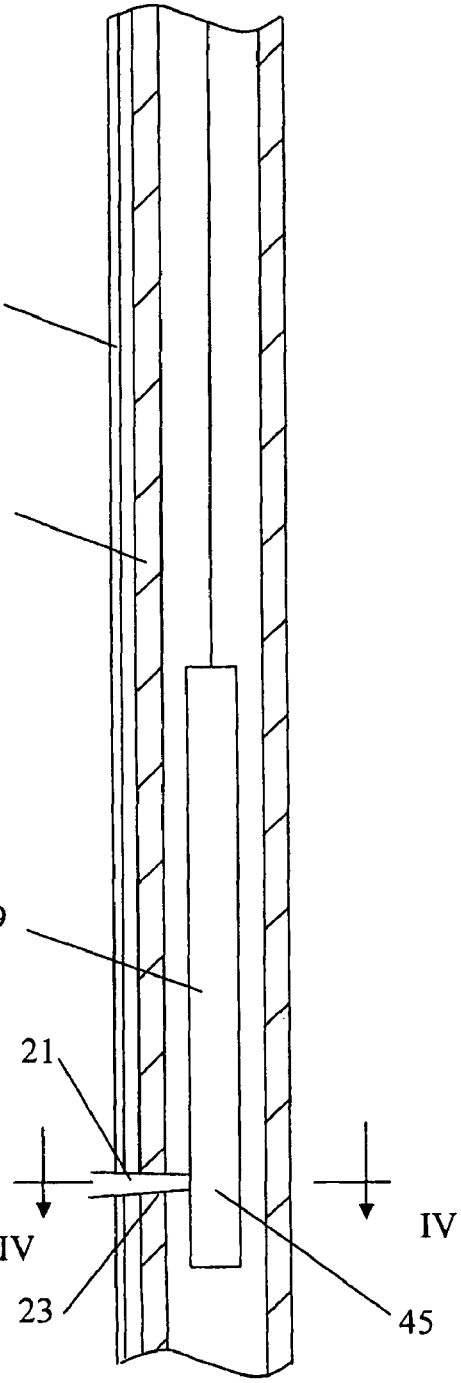
FIG. 3 depicts a cross-sectional view of the tubing, cable, and cutting device of FIG. 1 during actuation of the cutting device to form a cut in the tubing and cable.
Figure 2:
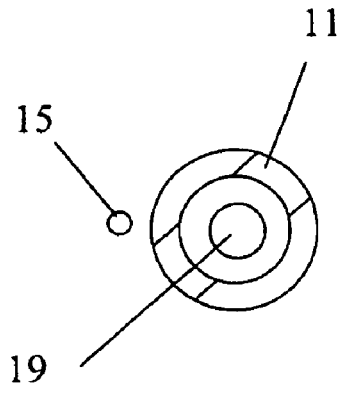
FIG. 2 depicts a cross-sectional view of the tubing, cable, and cutting device, taken along line II-II of FIG. 1.
Figure 4:
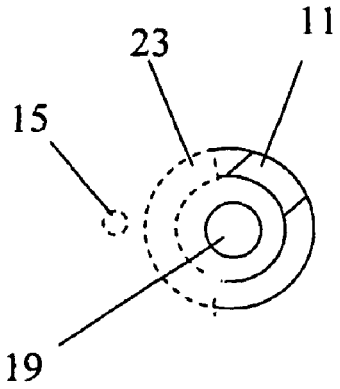
FIG. 4 depicts a cross-sectional view of the tubing, cable, and cutting device of FIG. 3, taken along line IV-IV of FIG. 3.

As shown in FIGS. 1 and 2, a first cutting apparatus (19) (e.g., a cable cutting torch) is lowered into the tubular member (11), the first cutting apparatus (19) having a nozzle for directing cutting fluids in a radial arc. The nozzle is oriented in the general direction of the cable (15), though in an embodiment, precise alignment of the nozzle with the cable (15) is not necessary. The first cutting apparatus (19) can be actuated to form a first cut (23, shown in FIGS. 3 and 4), e.g., by generating cutting fluid (21, shown in FIG. 3) in an arc toward the cable (15), as illustrated in FIGS. 3 and 4. The cutting fluid (21) can cut through the tubular member (11), creating the first cut (23) then cut through the cable (15) simultaneously. FIG. 4 depicts the cut portion of the tubular member (11) and cable (15) using dashed lines. Once the cable (15) is cut, the first cutting apparatus (19) can be removed from the tubular member (11).

Figure 5:
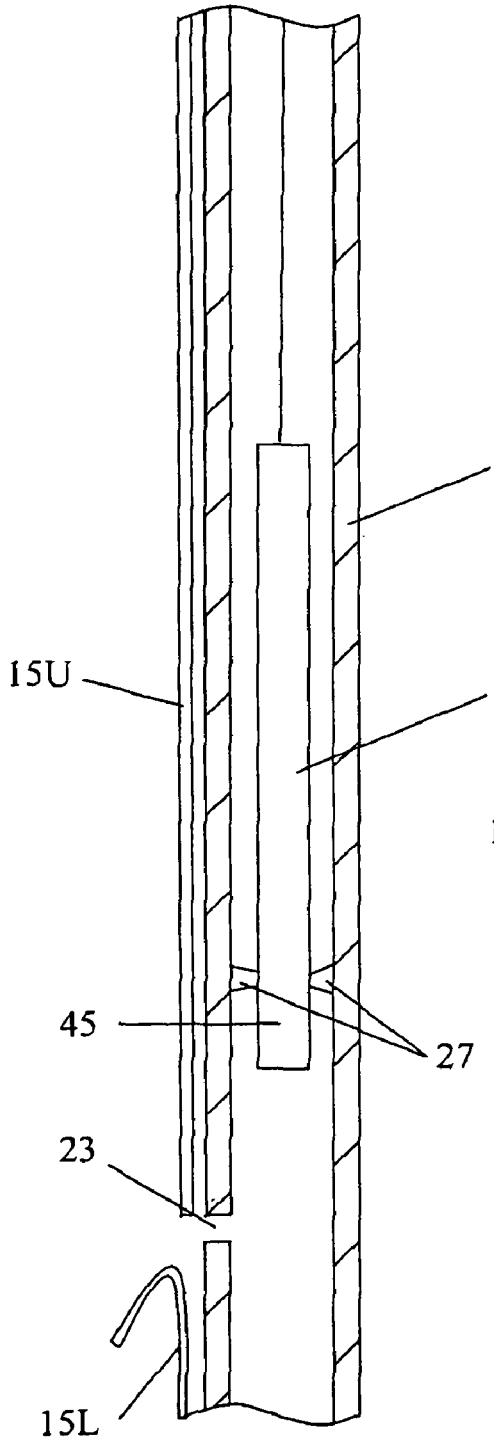
FIG. 5 depicts a cross-sectional view of the tubing and cable of FIG. 3, and a second cutting device positioned within the tubing.

FIG. 5 depicts a second cutting apparatus (25) (e.g., a tubing cutting torch) positioned within the tubular member (11) above the first cut (23). It should be noted that precise positioning of the second cutting apparatus (25) is not required, as the severed cable (15) will not impede retrieval of an upper portion of the tubular member (11) regardless of the height at which the tubular member (11) is cut. The second cutting apparatus (25) can be actuated, e.g., to generate cutting fluids (27) radially, about the complete circumference thereof, to create a circumferential cut (29) in the tubular member (11), thereby severing the tubular member (11) to form an upper portion (11U, shown in FIG. 6) and a lower portion (11L, shown in FIG. 6). The upper portion (11U) can be readily removed, unimpeded by the cable (15), such as through a pulling operation. The lower portion (11L) presents a clean, unobstructed length at its upper end (11F, shown in FIG. 7), which is suitable for retrieval via fishing operations or similar methods, thus enabling the entirety of the tubular member (11) to be salvaged and to prevent the need to abandon the well (13). It should be noted that while FIG. 5 depicts the second cutting apparatus (25) positioned above the first cut (23), in various embodiments, the circumferential cut (29) can be formed below the first cut (23).

The tubular member (11) described herein can include production tubing, although it should be understood that any type of pipe, tubing, and/or other tubular component or string of tubular members can also be used within the scope of the present disclosure. The cable (15) can include, without limitation, an electrical line, a hydraulic line, a mechanical cable, or other similar members. Typically, the cable (15) is located outside of the tubular member (11), which creates difficulty when attempting to sever the cable (15) due to the fact that the tubular member (11) effectively shields the cable (15) from a cutting torch or similar apparatus. Normally, the cable (15) can be attached to the tubular member (11) by one or more straps or clamps (not shown) at intervals along the length thereof, such that the cable (15) is in contact with the tubular member (11) along its length. Typically, the approximate location of the cable (15) on the circumference of the tubular member (11) is known.

Figure 8:
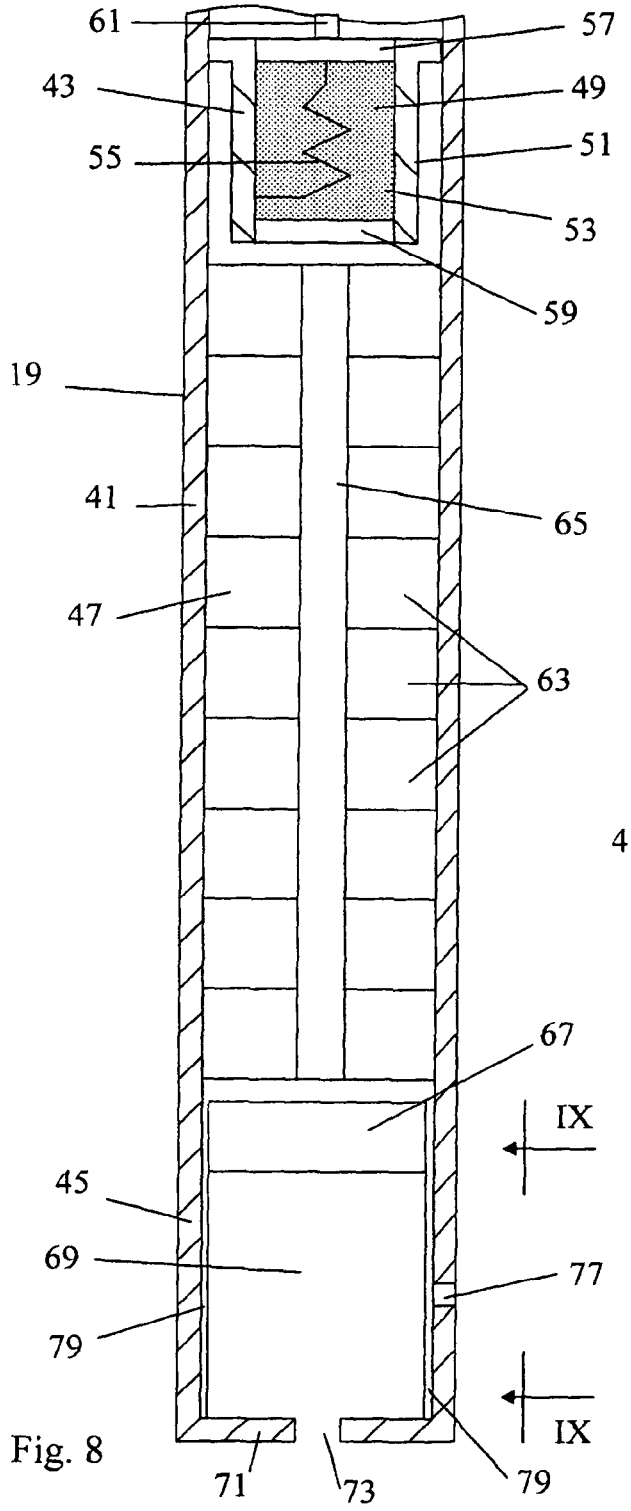
FIG. 8 depicts a cross-sectional view of an embodiment of the cutting apparatus of FIG. 1.

FIG. 8 depicts an embodiment of the first cutting apparatus (19), which is shown as a cable cutting torch having an elongate tubular body (41) with an ignition section (43), a nozzle section (45), and a fuel section (47) intermediate the ignition and nozzle sections (43, 45). In an embodiment, the tubular body (41) can be formed from three components, coupled together by threads. For example, the fuel section (47) can be formed from an elongate tube or body member, while the ignition section (43) is formed from a shorter extension member, and the nozzle section (45) is formed from a shorter head member.

The ignition section (43) is shown having an ignition source (49), which can include, for example, a thermal generator such as that described in U.S. Pat. No. 6,925,937, which is incorporated herein by reference in its entirety. The ignition source (49) can be a self-contained unit that can be inserted into an extension member, and is shown having a body (51), flammable material (53), and a resistor (55). The ends of the body (51) are shown having an upper end plug (57) and a lower end plug (59) therein. The upper end plug (57) is depicted having an electrical contact (61) that can connect to an electrical cable (not shown) or similar source of power. Thus, the upper end plug (57) can be electrically insulated from the body (51). The resistor (55) is shown connected between the electrical contact (61) and the body (51).

In an embodiment, the flammable material (53) can include a thermite, or a modified thermite mixture, e.g., a mixture of a powdered (or finely divided) metal and a powdered (or finely divided) metal oxide. Usable powdered metals can include, by way of example, aluminum, magnesium, and/or other similar metals. Usable metal oxides can include, by way of example, cupric oxide, iron oxide, and/or other similar metal oxides. In a preferred embodiment, the flammable material (53) includes a mixture of cupric oxide and aluminum. When ignited, the flammable material (53) can produce an exothermic reaction. In further embodiments, the flammable material (53) can have a high ignition point and be thermally conductive. For example, the ignition point of some thermite mixtures is as low as 900 degrees Fahrenheit, while the ignition point of a mixture of cupric oxide and aluminum is about 1200 degrees Fahrenheit. Thus, to ignite the flammable material (53), a temperature that meets or exceeds the ignition point must be provided.

The fuel section (47) can be used to contain the fuel for the first cutting apparatus (19). In a preferred embodiment, the fuel can include a stack of pellets (63), which can be donut and/or toroidal shaped, and made from a combustible pyrotechnic material. When stacked, aligned holes in the center of the pellets (63) can be filled with loose combustible material (65), which in an embodiment, can include the same material as that from which the pellets (63) are formed. Combustion of the combustible material can generate cutting fluids of a sufficient temperature and quantity to cut through the wall of a tubular member, if properly directed. Cutting fluids can include gasses, liquids, and combinations thereof.

The pellets (63) are shown adjacent to and abutting a piston (67) at the lower end of the fuel section (47). The piston (67) can be movable into and/or from the nozzle section (45).

The nozzle section (45) is depicted having a hollow interior cavity (69) and an end plug (71) opposite the piston (67). The end plug (71) can include a passage (73) that communicates with the exterior of the first cutting device (19). The sidewall of the nozzle section (45) can include one or more openings (77) that permit communication between the interior and exterior of the nozzle section (45). The nozzle section (45) is further shown having a sleeve or liner (79) (e.g., a carbon sleeve) that protects the tubular body thereof. The liner (79) can include perforations aligned with or proximate to the openings (77) to permit the passage of fluids.

In use, the piston (67) can initially be located in a position that isolates the pellets (63) from the openings (77). However, after the fuel is ignited, pressure of the cutting fluids generated by the ignited fuel can move the piston (67) into the nozzle section (45) to expose the openings (77) to the fluids. Thus, the cutting fluids can exit the first cutting apparatus (19) through the openings (77).

Figure 9:
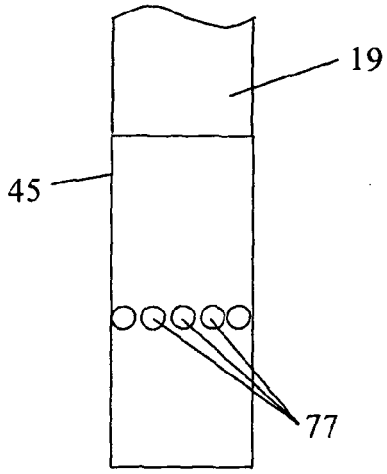
FIG. 9 depicts a side elevational view of an embodiment of a nozzle arrangement usable with the cutting apparatus of FIG. 8.

The openings (77) within the nozzle section (45) can be arranged in a circumferential arc, as shown in FIG. 9. While FIG. 9 depicts a plurality of horizontally aligned, circular openings, it should be understood that in various embodiments, the openings (77) can include a single opening in the form of a slot, or any number of openings, rectangular openings, or openings having any other shape or arrangement.

Figure 10:
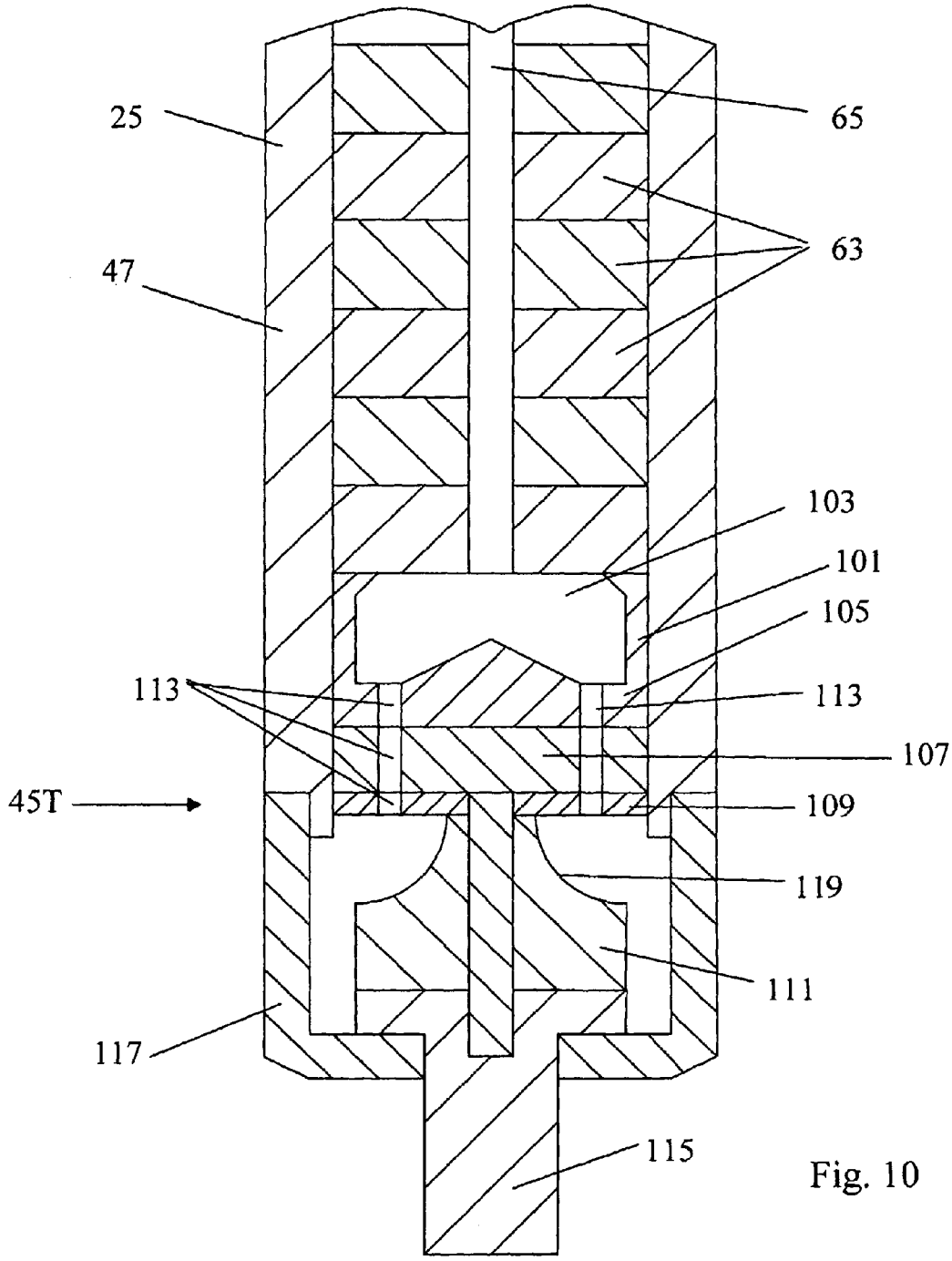
FIG. 10 depicts a cross sectional view of an embodiment of a lower nozzle section of the second cutting device of FIG. 5.
Figure 11:
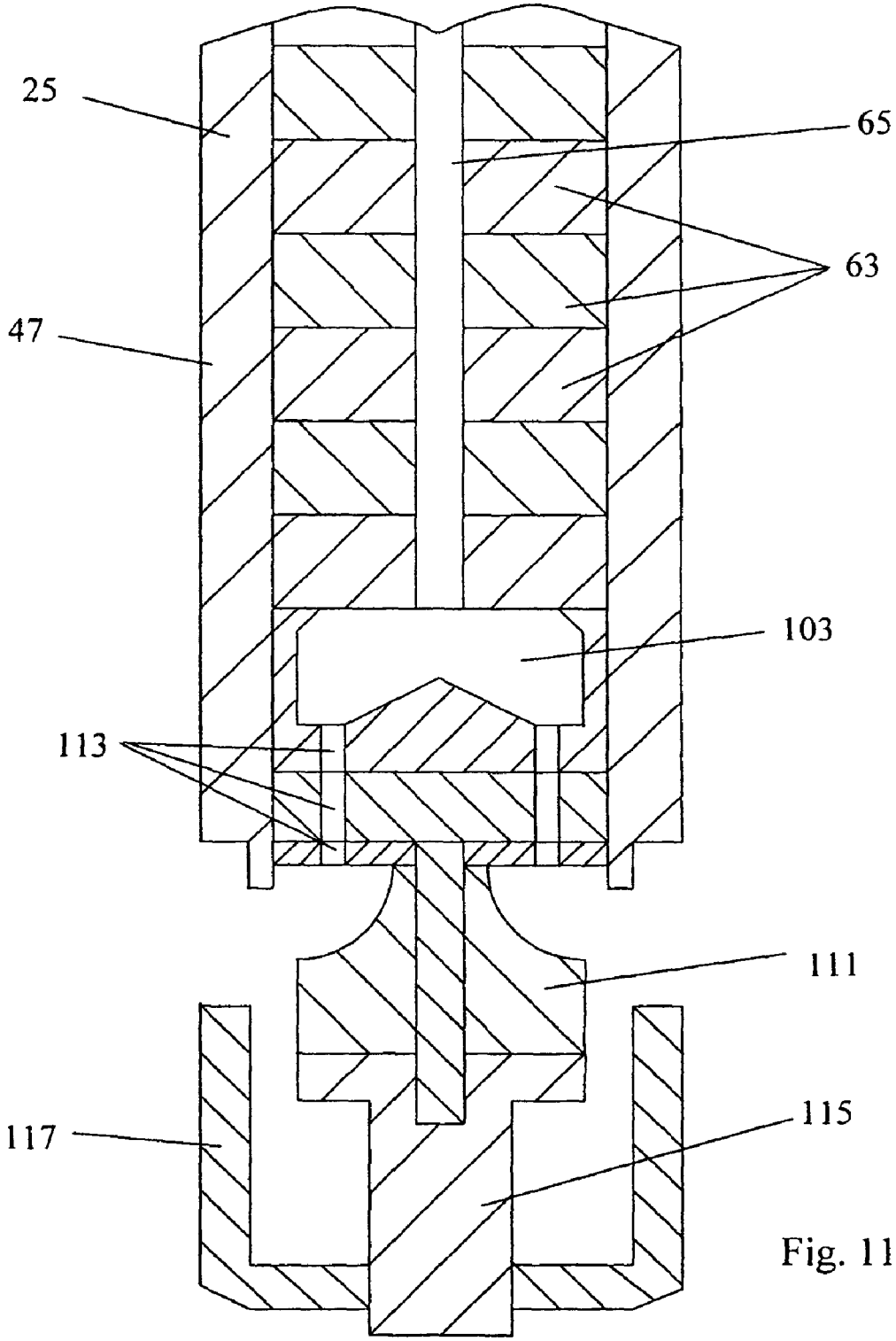
FIG. 11 depicts a cross-sectional view of the lower nozzle section of FIG. 10 in an open configuration.

FIGS. 10 and 11 depict a lower portion of an embodiment of the second cutting apparatus (25), which is shown as a radial cutting torch, similar to that described in U.S. Pat. No. 6,598,679, incorporated by reference above. The second cutting apparatus (25) is shown configured similarly to the first cutting apparatus (19), in that the depicted second cutting apparatus (25) includes an ignition section (43), a nozzle section (45T) and a fuel section (47). As shown in FIG. 10, the nozzle section (45T) includes a support (101) for supporting the pellets (63) above a mixing cavity (103). Below the mixing cavity (103), a carbon shield (105), a metal nozzle (107), a carbon retainer (109), and a carbon diverter (111) are shown; however, it should be understood that these components and their arrangement are only a single exemplary embodiment of a usable second cutting apparatus (25), and that other materials, components, arrangements, and/or other types of cutting devices can be used without departing from the scope of the present disclosure. Apertures (113) are shown extending through the shield (105), nozzle (107) and retainer (109), such that the mixing cavity (103) can communicate with a space above the diverter (111). The diverter (111) is shown having a surface (119) that is flared in a radially outward direction. Beneath the diverter (111), an anchor shaft (115) is shown, having a metal sleeve (117) thereon that moves along the anchor shaft (115) between open and closed positions. FIG. 10 depicts the sleeve (117) in a closed position in contact with the body of the second cutting apparatus (25), with the diverter (111) isolated from the exterior thereof. FIG. 11 depicts the sleeve (117) in an open position, moved away from the body to expose the diverter (111) to the exterior of the second cutting apparatus (25). During use, cutting fluids can move the sleeve (117) from the closed position to the open position, such that the diverter (111) can divert the cutting fluids radially outward, circumferentially (e.g., 360 degrees) about the second cutting apparatus (25), to cut a tubular member about its circumference.

Embodiments usable within the scope of the present disclosure also relate to a method for severing a tubular member (11). Referring again to FIG. 1, the first cutting apparatus (19) (e.g., a cable cutting torch) can be lowered into the tubular member (11), such as through use of an electric wireline or a similar conduit. The nozzle orifices (77) are generally oriented in the direction of the cable (15). For example, if it is known that the cable (15) is positioned on the north side of the tubular member (11), then the nozzle orifices (77) can be generally oriented in the north direction. Orientation equipment can be used in conjunction with the first cutting apparatus (19), such that the direction in which the orifices (77) are facing is known. In an embodiment, the arc of the openings (77) will typically span 180 degrees or less. Thus, the orienting of the first cutting apparatus (19) need not be precise for the arc of the cutting fluids produced through the opening (77) to intersect the cable (15). The length of the arc along which the cutting fluids are produced, and/or the quantity of fuel used to produce the cutting fluids, can be modified depending on the characteristics (e.g., thickness) of the tubular member (11). For example, a greater quantity of fuel can be used to enable cutting fluids to be projected along an arc of 180 degrees when cutting through thick walled tubing. Alternatively, if the precise location of the cable (15) and orientation of the first cutting apparatus (19) is known, the first cutting apparatus (19) can be oriented more precisely, and a narrow arc can be used.

In an embodiment, the first cutting apparatus (19) can be positioned above a stuck point in the tubular member (11), e.g., above the first cut (23). Ignition and/or actuation of the first cutting apparatus (19) is then performed. For example, if the first cutting apparatus (19) is a torch lowered on an electric wireline, an electrical signal can be sent to actuate the torch. Other methods of ignition can include use of a batter and/or trigger mechanism on a slick line, a pressure-actuated mechanism, a battery-powered drive bar, or combinations thereof.

When the first cutting apparatus (19) is actuated (see FIGS. 3 and 4), cutting fluids (21) exit the openings (77) in an arc, cut through the tubular member (11) forming a first cut (23), and sever the cable (15), forming an upper part (15U) and a lower part (15L) thereof. Generally, the portion of the tubular member (11) located in a direction not exposed to the openings (77) is not cut. Thus, the first cut (23) extends along a partial circumference of the tubular member (11). Therefore, the first cutting apparatus (19) can direct all of the cutting fluids (21) toward the cable (15), enabling the cable (15) to be cut in a single cutting operations. If the cutting fluids (21) intersect a strap or clamp for securing the cable (15) to the tubular member (11), the strap or clamp can also be cut.

After the cable (15) is severed, the first cutting apparatus (19) can be removed from the tubular member (11), and the second cutting apparatus (25) (e.g., a radial cutting torch) can be positioned therein, generally above the first cut (23), as shown in FIG. 5. If it is intended to fish or retrieve the lower portion (11L) of the tubular member (11), the second cutting apparatus (25) can be positioned a sufficient distance above the first cut (23) to allow use of fishing and/or retrieval tools. It should be noted that precise positioning of the second cutting apparatus (25) relative to the first cut (23) is not necessary.

Figure 7:
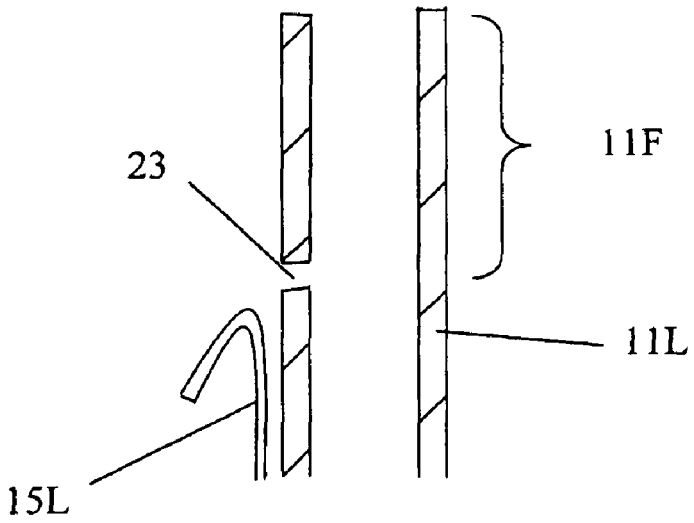
FIG. 7 depicts a cross-sectional view of a lower portion of the tubing and cable of FIG. 6 after retrieval of the upper portions thereof.
Figure 6:
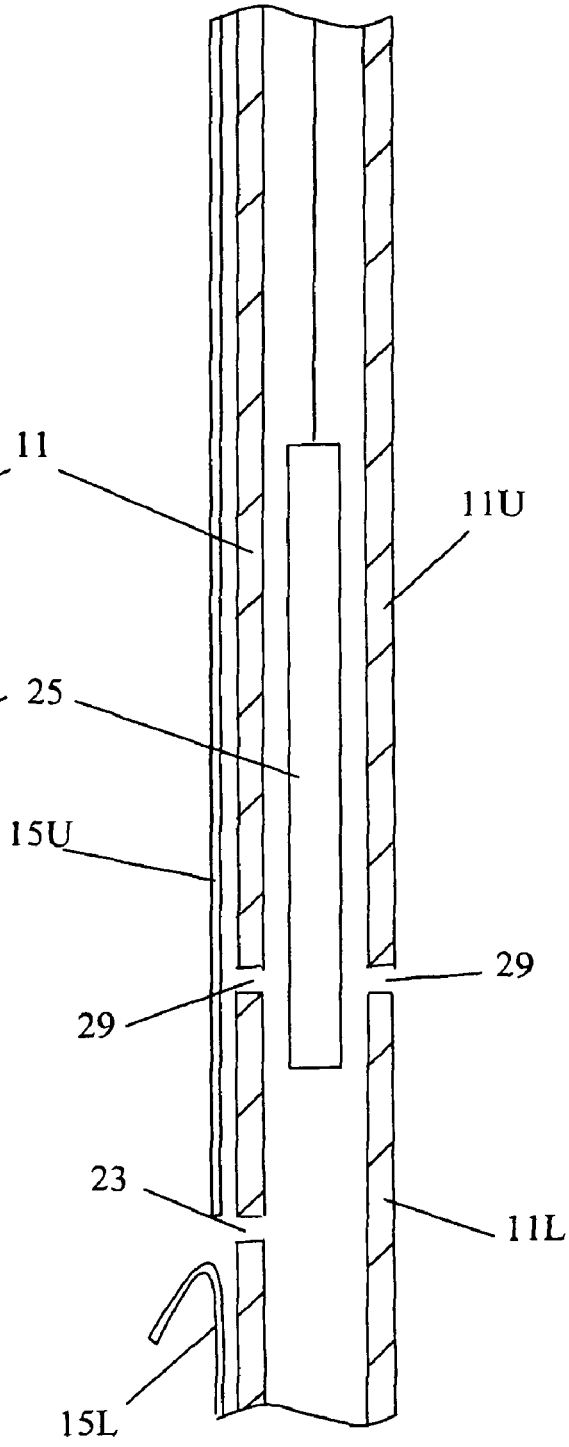
FIG. 6 depicts a cross-sectional view of the tubing, cable, and second cutting device of FIG. 5 after actuation of the second cutting device to sever the tubing.

Once positioned, the second cutting apparatus (25) can be actuated. For example, in an embodiment, the second cutting apparatus (25) can include a radial cutting torch that is ignited to produce cutting fluids (27) that are projected radially about the second cutting apparatus (25) to cut the tubular member (11) about the full circumference thereof, as shown in FIG. 6, forming a second cut (29), which separates the tubular member (11) into an upper portion (11U) and a lower portion (11L). The upper portion (11U) above the second cut (29) can be readily removed, along with the upper part (15U) of the cable (15). As shown in FIG. 7, the lower portion (11L) of the tubular member (11) and the lower part (15L) of the cable (15) remain in the well; however, the upper portion (11L) of the tubular member (11) presents a clean and unobstructed surface at its upper end (11F) suitable for retrieval by fishing tools. If any cable anchors, clamps, and/or straps remain intact after severing the cable (15), these anchors will typically yield or break when the upper portion (11U) of the tubular member (11) is pulled apart from the lower portion (11L).

While the above method describes use of the first cutting apparatus (19) to sever the cable (15) prior to actuating the second cutting apparatus (25) to fully sever the tubular member (11), in an embodiment, the second cutting apparatus (25) can be used to form the circumferential cut (29) prior to use of the first cutting apparatus (19) to sever the cable. This embodiment is may typically be used when the tubular member (11) is stabilized within a well in a manner that would prevent misalignment between the upper and lower portions (11U, 11L) thereof.

Each of the cutting apparatus (19, 25) can be provided with ancillary equipment, such as an isolation sub and/or a pressure balance anchor. For example, an isolation sub can be located on the upper end of a torch or similar device to protect tools (e.g., subs, sinker bars, collar locators, and similar tools), located above and/or attached to the device, from cutting fluids urged upward by various well conditions. An isolation sub can function as a check valve to prevent cutting fluids from entering a tool string above a cutting device.

A pressure balance anchor is typically located below a torch or similar cutting device and stabilizes the device during cutting operations. For example, a cutting torch is often urged in an uphole direction when actuated due to the force of the cutting fluids. A pressure balance anchor can resist such uphole movement and centralize a device within a tubular member, e.g., using mechanical bow spring-type centralizers and/or rubber finger-type centralizers.

Thus, embodiments described herein enable severing of tubular members and associated cables in a reliable manner, in which a single cutting apparatus can be used to cut through both the tubular member and cable, enabling removal of at least a portion of the tubular member using a second cutting apparatus, without requiring either cutting apparatus to be positioned precisely relative to the location of the cable and/or the location of the first cut made in the tubular member.

While various embodiments of the present invention have been described with emphasis herein, it should be understood that within the scope of the appended claims, the present invention might be practiced other than as specifically described herein.

What is claimed is:

1. A method for severing a tubular string having a cable extending along a length thereof, the method comprising the steps of:

a) lowering a cutting apparatus into the tubular string, wherein the cutting apparatus comprises a cutting torch having apertures therein for directing cutting fluids; and b) actuating the cutting apparatus by directing a single projection of cutting fluids through the apertures to both form a cut in the tubular string and sever the cable.

2. The method of claim 1, wherein the step of actuating the cutting apparatus comprises simultaneously forming the cut in the tubular string and severing the cable.

3. The method of claim 1, further comprising the step of severing the tubular string to form a first portion and a second portion.

4. The method of claim 3, further comprising the step of removing the first portion of the tubular string from the second portion of the tubular string.

5. The method of claim 4, wherein the step of severing the tubular string to form the first portion and the second portion comprises forming a generally horizontal cut in the tubular string to provide the second portion with an upper end configured for retrieval.

6. The method of claim 5, further comprising retrieving the second portion by engaging the upper end with a retrieval tool.

7. The method of claim 1, wherein the apertures are positioned to direct the cutting fluids in a circumferential arc of one hundred eighty degrees or less for enabling the cutting torch to direct the cutting fluids with sufficient force to cut both the tubular string and the cable, and wherein the step of actuating the cutting apparatus to form the cut comprises cutting the tubular string partially along a circumference thereof.

8. The method of claim 1, wherein the step of actuating the cutting apparatus to form the cut comprises cutting the tubular string partially along a circumference thereof.

9. The method of claim 8, wherein cutting the tubular string partially along the circumference thereof comprises forming the cut along a circumferential arc of 180° or less.

10. The method of claim 1, wherein the cable is positioned exterior to the tubular string and the cutting apparatus is positioned interior to the tubular string, and wherein the step of actuating the cutting apparatus to form the cut comprises both cutting the tubular string and severing the cable proximate to the first cut.

11. A method for severing a tubular string having a cable extending along a side thereof, the method comprising the steps of:

a) lowering a cutting apparatus into the tubular string and orienting the cutting apparatus to form a cut toward the side of the tubular string along which the cable extends; and b) actuating the cutting apparatus to form the cut in the tubular string partially along a circumference thereof, wherein forming the cut in the tubular string severs the cable.

12. The method of claim 11, further comprising the step of severing the tubular string to form a first portion and a second portion.

13. The method of claim 12, further comprising the step of removing the first portion of the tubular string from the second portion of the tubular string.

14. The method of claim 12, wherein the step of severing the tubular string to form the first portion and the second portion comprises forming a generally horizontal cut in the tubular string to provide the second portion with an upper end configured for retrieval.

15. The method of claim 14, further comprising retrieving the second portion by engaging the upper end with a retrieval tool.

16. The method of claim 11, wherein the cutting apparatus comprises a cutting torch having apertures therein for directing cutting fluids, and wherein the step of actuating the cutting apparatus to form the cut comprises directing cutting fluids through the apertures.

17. The method of claim 16, wherein the apertures are positioned to direct the cutting fluids in a circumferential arc of one hundred eighty degrees or less for enabling the cutting torch to direct the cutting fluids with sufficient force to cut both the tubular string and the cable, and wherein the step of actuating the cutting apparatus to form the cut comprises cutting the tubular string partially along a circumference thereof.

18. A method for severing a tubular string having a cable extending along a length thereof, the method comprising the steps of:

a) lowering a cutting apparatus into the tubular string; and b) actuating the cutting apparatus to form a cut in the tubular string partially along a circumference thereof and sever the cable.

19. A method for severing a tubular string having a cable extending along a length thereof, the method comprising the steps of:

a) lowering a cutting apparatus into the tubular string; and b) actuating the cutting apparatus to form a single cut through the tubular string and the cable, thereby severing the cable.

* * * * *